US005133459A

United States Patent [19]

Genix

[11] Patent Number: 5,133,459

[45] Date of Patent: Jul. 28, 1992

[54] SHIPPING CONTAINER FOR AN ARTICLE INCLUDING A RAMP AND CUSHION ASSEMBLY

[75] Inventor: Pete D. Genix, Austin, Tex.

[73] Assignee: Dell USA Corporation, Austin, Tex.

[21] Appl. No.: 759,123

[22] Filed: Sep. 6, 1991

Related U.S. Application Data

[63] Continuation of Ser. No. 585,437, Sep. 20, 1990, abandoned.

[51] Int. Cl.[5] ..... B65D 81/04; B65D 85/38; B61D 45/00

[52] U.S. Cl. ..... 206/586; 206/305; 206/320; 206/335; 410/129; 414/537

[58] Field of Search ..... 206/305, 320, 326, 335, 206/386, 599, 216, 521, 586; 410/129, 140; 414/537

[56] References Cited

U.S. PATENT DOCUMENTS

| | | | |
|---|---|---|---|
| 1,006,025 | 10/1911 | Taylor | 414/537 X |
| 1,346,891 | 7/1920 | Huwyler | 414/537 |
| 1,380,229 | 5/1921 | Manheim | 414/537 X |
| 2,056,279 | 10/1936 | Kulick | 206/804 X |
| 2,797,800 | 7/1957 | Sider | 206/521 X |
| 2,911,094 | 11/1959 | Nagel | 206/320 X |
| 3,511,393 | 5/1970 | Abromavage et al. | 414/537 |
| 3,613,914 | 10/1971 | Jaekle | 414/537 X |
| 3,711,882 | 1/1973 | Iller | 414/537 X |
| 3,889,866 | 6/1975 | Keller | 206/521 |
| 4,759,446 | 7/1988 | Dobashi et al. | 206/586 |
| 4,798,294 | 1/1989 | Bodi | 206/320 X |

*Primary Examiner*—Bryon P. Gehman
*Attorney, Agent, or Firm*—Thomas G. Devine

[57] ABSTRACT

A shipping container for an article includes a floor on which the article is placed, the top surface of which is elevated from the supporting surface upon which the container rests, by a fixed dimension. Four side structures surround the floor and a top panel contacts the side structures to form an enclosure for the article. One of the side structures has at least one flap that, when opened, permits a ramp, that is part of the side structure, in the form of an inclined plane, to be pivoted into position against the floor. The height of the inclined plane approximates the fixed dimension so that the article can be moved horizontally within the container and then down the ramp for removal. Reinstallation of the article into the container requires moving the article up the inclined plane, onto the floor of the container.

3 Claims, 4 Drawing Sheets

SHIPPING CONTAINER FOR AN ARTICLE INCLUDING A RAMP AND CUSHION ASSEMBLY

This application is a continuation of application Ser. No. 07/585,437, filed Sep. 20, 1990, now abandoned.

BACKGROUND OF THE INVENTION

1. Field of the Invention

This invention relates to a shipping container for packing articles such as digital computers, and more particularly to a shipping container having facility for easy removal of the computer from the shipping container.

2. Description of the Related Art

In the past, it has been typical to place personal computers and the like into a packing box such as a corrugated fiber board box whose dimensions of length, width and height are made larger than the corresponding dimensions of a computer and the like to be place in the box for shipping. Often the computer is wrapped in a vinyl bag and placed in the box together with cushion members made of, for example, expandable polyurethane to cushion the computer. Generally the box is open at one end of the computer is lifted out. While some models of personal computers are now smaller than in the past, many are larger and heavier, and therefore removal from a shipping container has become a difficult task.

To aid in removing the computer, a handle has been attached to the computer. The addition of this handle makes the job of removal somewhat easier. However, the computer must still be lifted or forcibly pulled from the box.

The instant invention permits easy removal of even a large size personal computer unit.

BRIEF SUMMARY OF THE INVENTION

A shipping container for an article (floor standing unit of a digital computer in this preferred embodiment) is disclosed. The container has a floor that is elevated above the supporting surface upon which the container rests. Four panels surround the floor, forming an enclosure for the unit. A top panel complete the enclosure. One of the panels is a compound panel, being made up of four flaps that are swung open to uncover a ramp assembly which may then be pivoted downward to rest on the bottom flap which in turn contacts the supporting surface. The ramp, configured as an inclined plane, abuts the floor and is of a height approximating the elevation of the floor so that the unit can be moved horizontally within the container until reaching the inclined plane. At that point, the computer unit is moved down the inclined plane to the supporting surface. The computer unit may have wheels attached, making the removal easier.

The shipping container can be reused, with the computer unit being reloaded by moving it up the ramp into the container and then rotating the ramp and flaps back into a closed position.

The principal object of this invention is to provide a shipping container for an article to make removal of the article physically much easier than from a conventional shipping container.

Another object of this invention is to provide a shipping container for reinstalling an article for reshipment, with such reinstallation requiring less physical effort than when reshipping in a conventional shipping container. These and other objects will be made evident in the detailed description that follows.

DETAILED DESCRIPTION OF THE INVENTION

The shipping container of this invention permits easy unloading of an article and easy reloading of that article. The lifting requirement and the pulling force requirement of the prior art is alleviated by this invention.

Figure 1A:
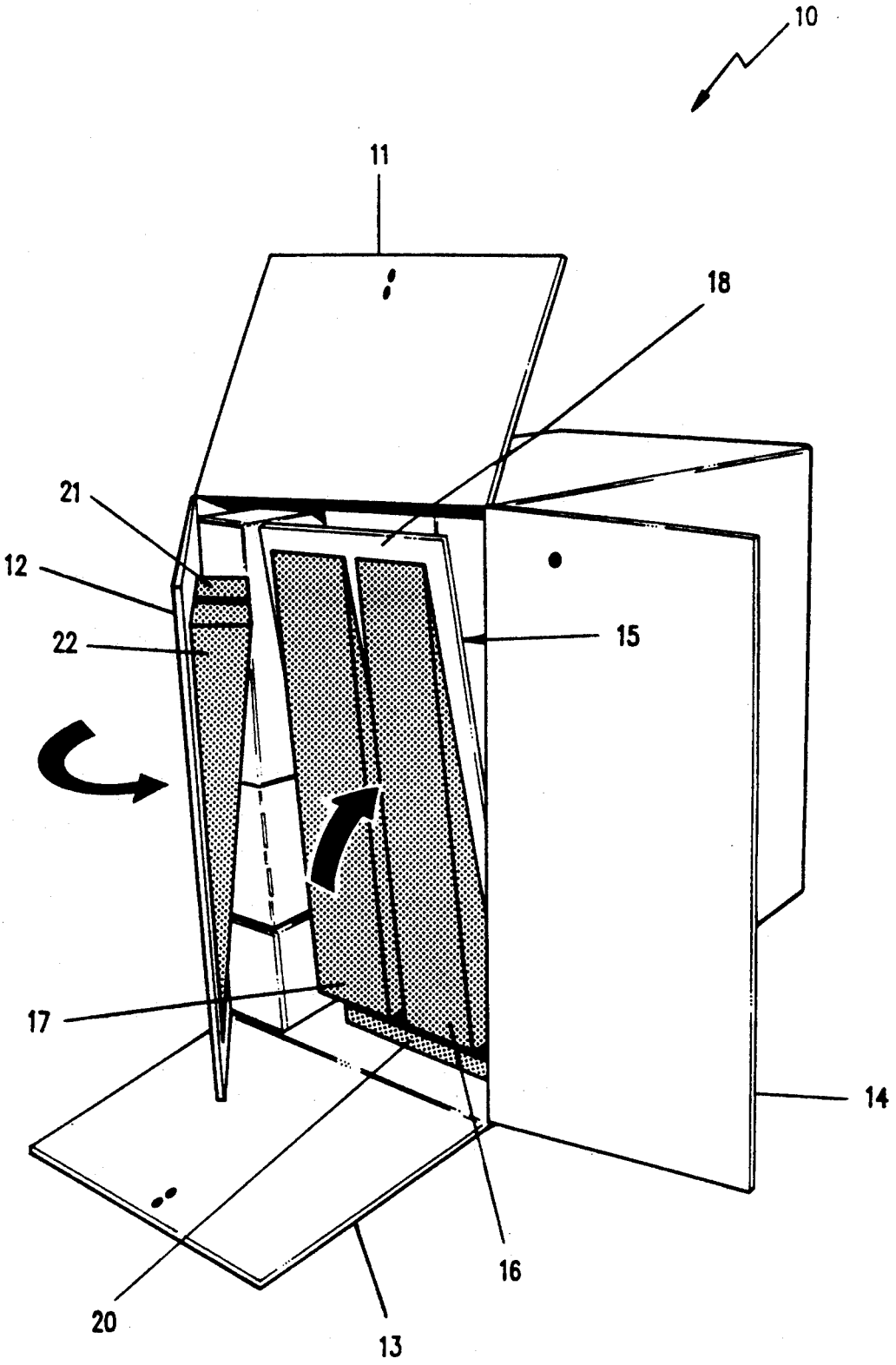
FIG. 1A illustrates three of the flaps of the shipping container being opened, with the fourth flap partially opened.

Turning first to FIG. 1A, shipping container 10 with the computer unit 40 (see FIG. 1C) inside is shown having flaps 11, 13 and 14 opened and flap 12 partially open. Cushion pieces 16 and 17, in the form of inclined planes are attached to panel 18 to form a ramp 15. As shown, ramp 15 pivots upwardly or downwardly. Cushion pieces 21 and 22 nest with cushion pieces 17 and 16, respectively to hold computer unit 40 securely in place. The cushion material in this preferred embodiment is an expandable polyurethane, but could obviously be formed of other materials as well.

Figure 1B:
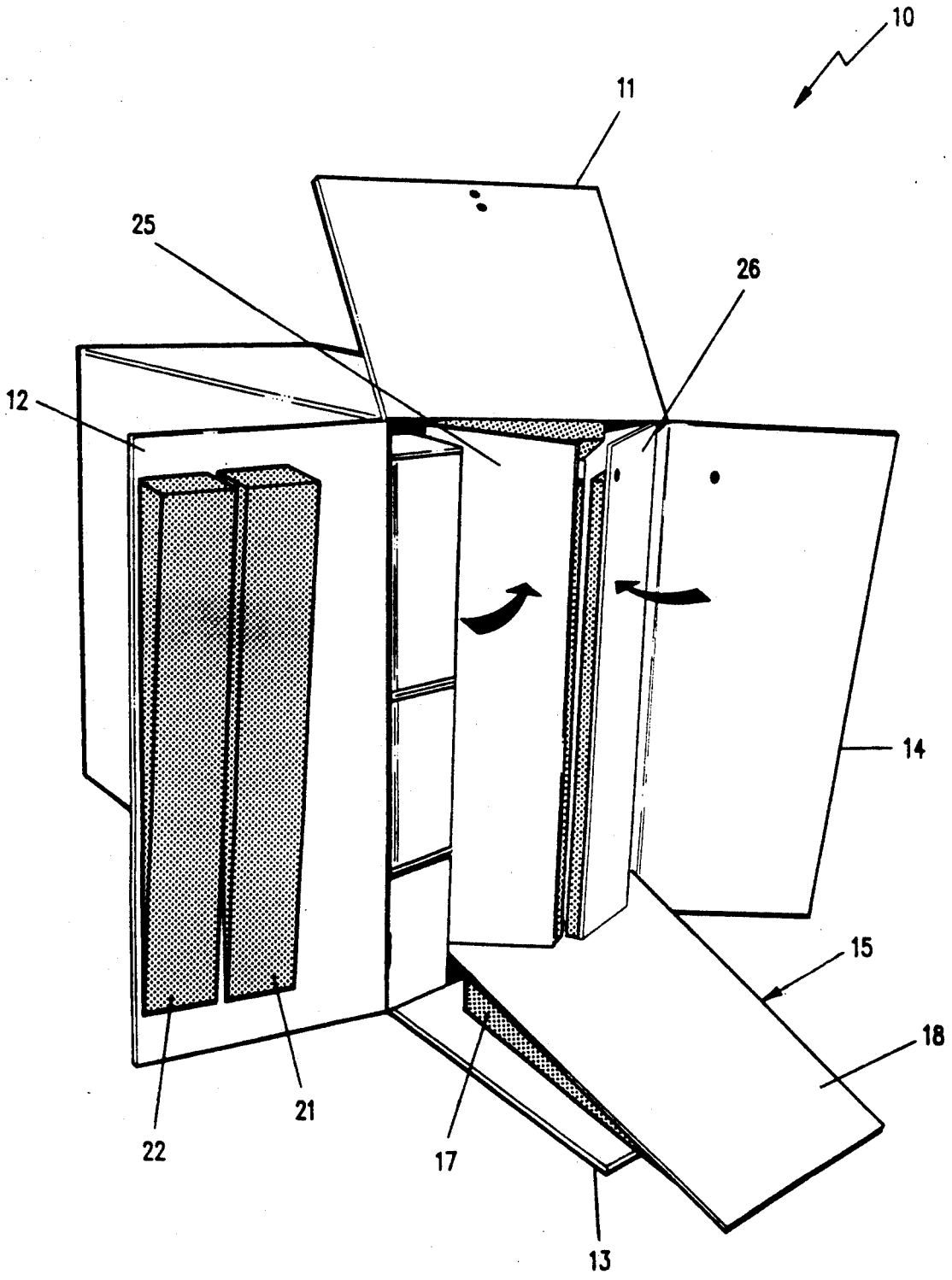
FIG. 1B illustrates the four flaps open, the ramp in place and two inner flaps being opened.

FIG. 1B illustrates ramp 15 being pivoted downwardly and panel 12 having been pivoted to a completely open position so that inner panels 25 and 26 are movable outwardly as shown.

Figure 1C:
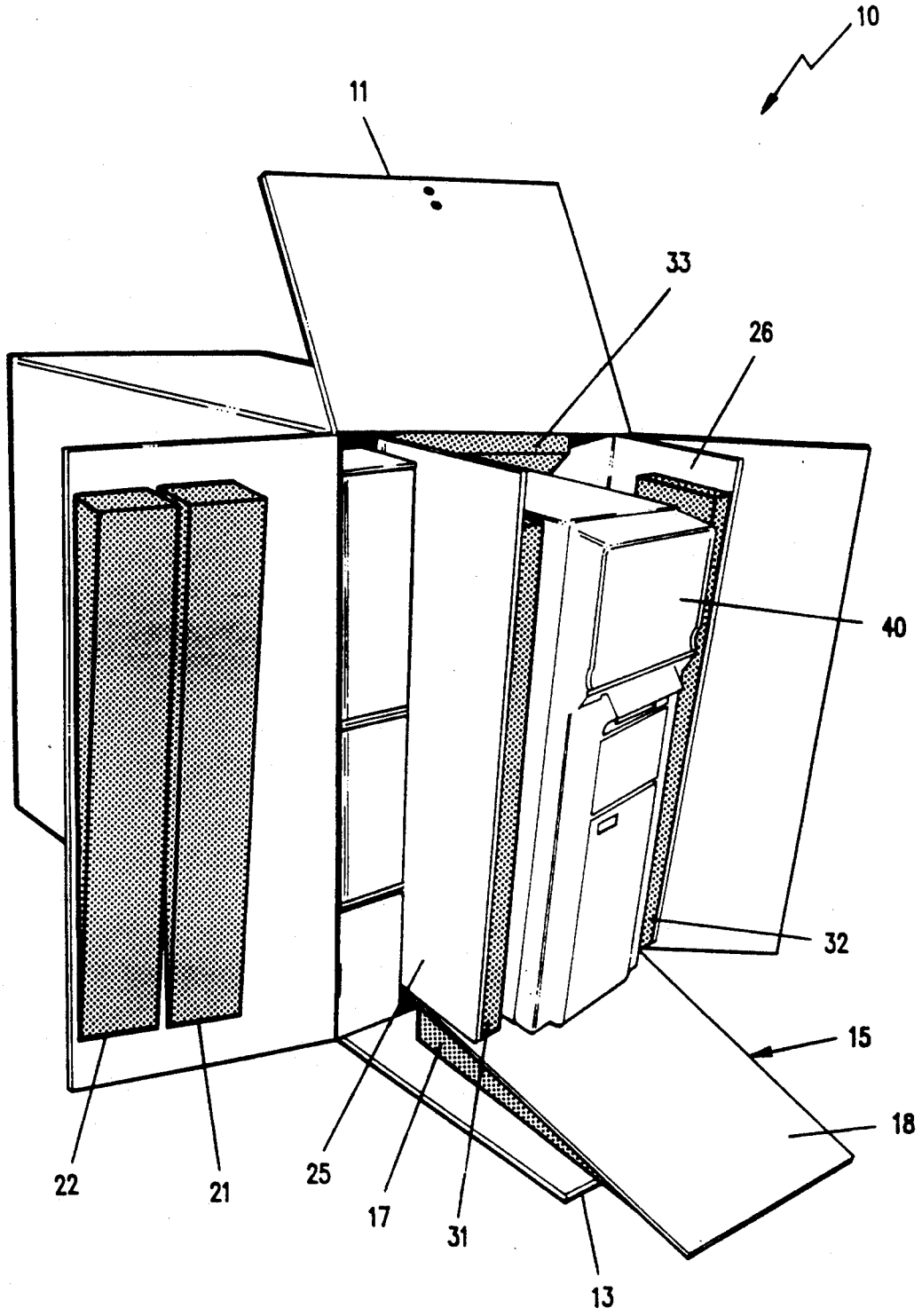
FIG. 1C illustrates the computer unit being removed from the container, moving down the ramp.

FIG. 1C illustrates computer unit 40 moving down ramp 15 with inner panels 25 and 26 fully open. Cushioning panels 31 and 32 are shown attached to inner panels 25 and 26, respectively. Further cushioning material 33 is shown above and behind computer unit 40.

Figure 2:
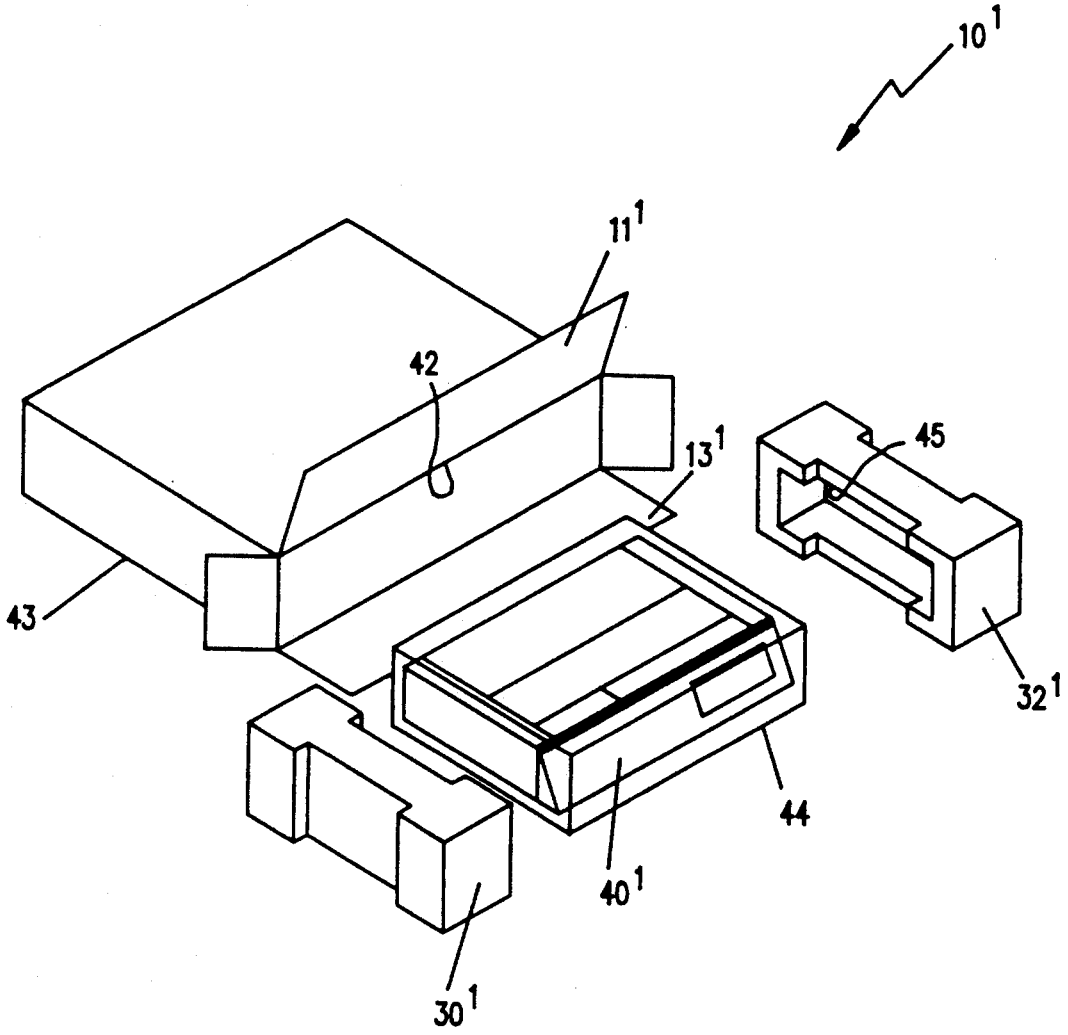
FIG. 2 illustrates a computer unit and typical prior art shipping container therefor.

FIG. 2 illustrates a typical prior art shipping container 10' made up of a shipping box 43 having an opening 42 when flaps 11' and 13' are opened as shown. Computer unit 40' is inserted into box 43, along with cushioning inserts 31' and 32'. In this prior art system, computer 40' is placed in a plastic bag 44 and inserted, along with cushion members 31' and 32'. For removal, cushion members 31' and 32' and computer unit 40' within plastic bag 44 are all removed from box 43.

MODE OF OPERATION OF THE INVENTION

Turning first to FIG. 1A, flaps 11–14 are opened as shown.

FIG. 1B illustrates the pivoting downwardly of ramp 15 and the opening of inner panels 25 and 26.

FIG. 1C illustrates the removal of computer unit 40 through inner panels 25 and 26 which have been opened, and down ramp 15.

To reinstall the computer 40 for reshipment, computer unit 40 is simply moved up ramp 15 into the container. Inner panels 25 and 26 are closed, ramp 15 is pivoted upwardly, and panel 12 is closed followed by panels 14, 11 and 13.

Those skilled in the art may vary the number of flaps and inner panels, the placement of the cushioning material, and the type of materials, all without departing from the spirit and scope of this invention which is limited only by the appended claims.

I claim:

1. A container for an article, the container resting upon and supported by a supporting surface, comprising:

(a) a floor on which the article is placed at an elevation above the supporting surface;

(b) a plurality of side structures contacting the floor and forming an enclosure for the article, at least one of the side structures being openable to allow removal of the article; and (c) a ramp and cushion assembly associated with the openable side structure, the ramp and cushion assembly being positioned to cushion and hold the article in place and being pivotable for placing adjacent the floor at one end and resting upon the supporting surface to provide an inclined plane on which the article is moved to effect a removal of the article to the supporting surface.

2. The container of claim 1 wherein the openable side structure comprises at least one flap that, when opened, allows the ramp and cushion assembly to be pivoted into position for removing the article.

3. The container of claim 2 wherein the height of the ramp and cushion assembly approximates the elevation of the floor above the supporting surface, thereby enabling the article to be moved horizontally within the container and down the inclined plain for removal when the inclined plane is pivoted into position.

* * * * *